US008963430B2

(12) United States Patent
Walker

(10) Patent No.: US 8,963,430 B2
(45) Date of Patent: Feb. 24, 2015

(54) CIRCUIT FOR DETECTION AND CONTROL OF LED STRING OPERATION

(75) Inventor: James T Walker, Palo Alto, CA (US)

(73) Assignee: Microchip Technology Inc., Chandler, AZ (US)

( * ) Notice: Subject to any disclaimer, the term of this patent is extended or adjusted under 35 U.S.C. 154(b) by 0 days.

(21) Appl. No.: 13/451,457

(22) Filed: Apr. 19, 2012

(65) Prior Publication Data

US 2012/0268012 A1 Oct. 25, 2012

Related U.S. Application Data

(60) Provisional application No. 61/477,999, filed on Apr. 21, 2011.

(51) Int. Cl.
*H05B 37/02* (2006.01)
*H05B 33/08* (2006.01)

(52) U.S. Cl.
CPC ..... *H05B 33/0893* (2013.01)
USPC ..... 315/122; 315/121; 315/131; 315/185 R; 315/312

(58) Field of Classification Search
USPC ..... 315/185 R, 186, 192, 291, 297, 307, 315/308, 312
See application file for complete search history.

(56) References Cited

U.S. PATENT DOCUMENTS

| | | | | |
|---|---|---|---|---|
| 8,368,322 | B2 * | 2/2013 | Yu et al. | 315/306 |
| 8,531,132 | B2 * | 9/2013 | Oh et al. | 315/307 |
| 2007/0195025 | A1 | 8/2007 | Korcharz et al. | |
| 2008/0164828 | A1 * | 7/2008 | Szczeszynski et al. | 315/300 |
| 2009/0128045 | A1 * | 5/2009 | Szczeszynski et al. | 315/185 R |
| 2009/0302776 | A1 | 12/2009 | Szczeszynski | |
| 2009/0315481 | A1 | 12/2009 | Zhao | |
| 2010/0308739 | A1 | 12/2010 | Shteynberg et al. | |
| 2011/0175547 | A1 * | 7/2011 | Oh et al. | 315/294 |
| 2012/0248997 | A1 * | 10/2012 | Jung et al. | 315/192 |
| 2013/0026926 | A1 * | 1/2013 | Oh et al. | 315/122 |
| 2013/0200802 | A1 * | 8/2013 | Sakuragi et al. | 315/122 |

OTHER PUBLICATIONS

PCT International Search Report of PCT/US12/34549; dated Aug. 13, 2012 (2 pgs.).

PCT Written Opinion of the International Searching Authority of PCT/US12/34549; dated Aug. 13, 2012 (6 pgs.).

* cited by examiner

*Primary Examiner* — Don Le

(74) *Attorney, Agent, or Firm* — DLA Piper LLP US; Brent Yamashita

(57) ABSTRACT

A circuit is disclosed for determining which of a multiplicity of LED strings in an illumination system has a fault. A group of circuits determines the maximum, minimum, midpoint between maximum and minimum, and average voltage of the group of LED string voltages in use, and examines the statistical properties of the LED string voltages. Comparators are used to find the strings which have the highest and lowest operating voltages, and to compare the midpoint and average voltages to determine whether the highest or lowest voltage string is responsible for causing a fault in the illumination system operation. Memory means are used to keep the said determined string turned off to prevent faulty operation.

25 Claims, 9 Drawing Sheets

LET R8=R9=R10

KCL: $i1+i2+i3=0$ (1)

Therefore $\frac{VCH1-VAVG}{R8}+\frac{VCH2-VAVG}{R9}+\frac{VCH3-VAVG}{R10}=0$ (2)

$VCH1+VCH2+VCH3=3*VAVG$ (3)

or $VCH1+\cdots+VCHn=N*VAVG$ (4)

CIRCUIT FOR DETECTION AND CONTROL OF LED STRING OPERATION

PRIORITY CLAIM

This application claims priority under 35 USC 119(e) and 120 to U.S. Provisional Patent Application Ser. No. 61/477,999, titled "A Circuit for Detection and Control of LED String Operation," filed on Apr. 21, 2011, which is incorporated by reference herein.

FIELD OF THE INVENTION

A circuit for detection and control of LED strings is disclosed

BACKGROUND AND SUMMARY OF THE INVENTION

Consider a power control system for light emitting diodes (LED) as shown in FIG. 1 (which depicts an embodiment to be discussed below). The purpose of this system is to provide controlled current for operation of the N LED strings STR denoted as 10 through 12. To this end, a multiplicity of N current sinks $I_1$ through $I_n$ denoted as 1, 2, and 3 are used to control the current through the LED strings. These current sinks may have different values, or may be operating at different times, without affecting the considerations being discussed below. A series combination of a current sink 1, a switch 4, and an LED string 10, for example, is denoted as a channel. The voltage source $V_1$ is optimally chosen to have a value just large enough that all of the current sinks operate correctly. If the channel voltages $V_{CH1}$, $V_{CH2}$, through $V_{CHn}$ are of sufficient magnitude, the current sinks are able to control the current flowing through the associated LED string. Practical realization of the power control system is usually done by an integrated circuit as known in the state of the art, associated with a few external components.

For normal operation, all the LED strings $STR_1$ through $STR_n$ will have similar voltage drops for the amount of sink current flowing through the strings. In this case, power dissipation in the current sinks caused by the channel voltages $V_{CH1}$ through $V_{CHn}$ will be relatively small, giving efficient production of light output by the LEDs without wasting input power.

During normal operation, a voltage detector circuit 14 is used to determine the channel which has the minimum value of $V_{CH}$, and uses that voltage to provide minimum voltage feedback to control the power source 13 for all the LEDs. In this way, the channel with the lowest value of voltage across its current sink is provided just sufficient voltage so that the current sink works correctly. All other channels have higher voltages for $V_{CH}$, so their current sinks also work correctly. Normal statistical variations in the operating voltage drops of the LEDs will cause the channel voltages $V_{CH}$ to vary among the channels, with the lowest channel voltage controlling the power source 13 to generate an optimum voltage $V_1$.

Operation of the LED strings begins with the channel enable signals 17 being turned on, so that a memory device in the control memory 16 associated with each LED string 10 to 12 is turned on, thereby closing the switches SW1 through SWn. When these switches are closed, current from the voltage source 13 can flow through the LED strings 10 to 12 to the current control sink circuits 1 to 3.

One objective of this disclosure is to discuss a means for performing the voltage detection in block 14 so as to find and disconnect failed LED strings, thereby preventing damage to the integrated circuit system. A further object is to provide a means for improving the power efficiency of the LED system by minimizing power dissipated, thereby reducing the total power consumed in production of a given amount of light output from the LEDs. If the integrated circuit system is dissipating excessive power as heat, this power does not contribute to the light output of the LEDs, but it will reduce the operating lifetime of a battery power source.

In an adverse operating condition, one or more of the LED strings may have one or more failed LEDs, said LED having either a larger or a smaller voltage drop than normal. If this causes the voltage across one or more channel current sinks to be too large, the power lost in the current sinks will cause excessive device heating. In this case, some means must be provided for determining which of the LED strings has the failed device and removing the string from usage.

The voltage detector 14 has several sets of outputs. The signals CHH tell which of the channel voltages VCH is the highest, signals CHL tell which of the channel voltages VCH is the lowest, and signal SNO tells whether the fault is likely to be due to an excessively high or low voltage. These signals go to a fault logic block 21, where logical combinations of the above signals are used to determine which LED channel is faulty so it can be turned off. The fault logic block 21 provides a set of outputs 15 denoted ERS, typically on separate wires, which can denote the presence of a failed LED string and assist in turning it off. These outputs are used to connect to a control memory block 16, which receives the channel enable signals 17 denoted CHEN together with a trigger signal TR on 20 and generates the control signals CHON on 18 to the switches 4 through 6 in each channel. An active CHEN signal initially turns on the current sink for an LED channel, and an active TR signal indicates that a fault is present and the power dissipation needs to be reduced. When the CHON signal is active, the corresponding LED channel is allowed to operate. If the CHON signal is not active, then the current sink for the LED channel is turned off, and the channel voltage VCH is no longer used to help control the voltage V1 of the power source 13. The control memory block typically contains a memory device for each channel, so that once a channel is recognized as having a failure, that channel can be turned off and the presence of the failure will be remembered.

Consider the case when an LED string has a device which has a large operating voltage drop, or is an open circuit, causing the corresponding channel voltage VCH to drop towards zero. The minimum voltage feedback value to the power source 13 will correspondingly fall to zero, causing the power source 13 to increase its output $V_1$ until the minimum channel voltage is brought back to its desired value. As a result, the value of VCH for all other channels will be increased, causing the power dissipation in the current sinks of all other channels to increase. This can lead to excessive power dissipation in the overall system used to create the current sinks, damaging the integrated circuit. In the case where an open device is present, the voltage source 13 may increase its output $V_1$ until some device in the system suffers breakdown and damage due to excessive applied voltage. This can result in catastrophic failure of the entire LED illumination system. Usually a separate, independent circuit is used to limit the voltage excursion of the voltage source 13 under these conditions to prevent catastrophic failure.

Therefore, one objective of the voltage detector 14 is to be able to determine if a large voltage drop string STR is present, and isolate it from the operation of the remainder of the system to prevent power loss, overheating, or catastrophic damage.

Now consider the case where an LED string has one or more devices which have less voltage drop than normal or even are shorted out and having no voltage drop. If a sufficient number of these devices are present in a particular string, then the corresponding current sink (1, for example) would have excessive power dissipation. If several LEDs have failed, this power dissipation can become sufficient to endanger the continued operation of the integrated circuit system. In this case the voltage detector 14 would cause the fault logic block outputs 15 to indicate which of the channels has excessive voltage $V_{CH}$ present at its current sink 1. The information is then used by the control memory block 16 to remember which string has the fault, and the control memory sends a signal on one of the wires 18 to turn off the switch which is associated with the failed string. As an example, if some of the LEDs in string STR1 (item 10) have less voltage drop than normal, the voltage $V_{CH1}$ may cause excessive power dissipation. In this case, the voltage detector 14 would send a signal on one of the wires 15 to cause the memory device in the control memory 16 associated with switch SW1 (item 4) to turn off. The string STR1 would then not draw power or cause excessive power dissipation in current sink $I_1$ (item 1).

Therefore another objective of the voltage detector 14 is to be able to determine if an LED string STR has less voltage drop than the remaining strings, and isolate it from the operation of the remainder of the system to prevent power loss, overheating, or catastrophic damage.

The question of whether a fault condition exists is determined by other circuitry not shown here, which may typically operate to declare a fault condition if the integrated circuit temperature becomes excessive, if the voltage $V_{CH}$ on any individual wire becomes more than a predetermined value, or if the power source 13 has an output voltage $V_1$ greater than a safe value. Other criteria for presence of a fault may also be used. The purpose of the circuit discussed here is to determine without ambiguity which of the LED channels has the fault. If a fault is judged to be present, the trigger wire TR becomes active to cause the error detection and control circuitry to turn off the defective LED channel.

Determination of which channel has the fault can be done by a voltage detector with a block diagram as shown in FIG. 2, in conjunction with the fault logic which will be shown later in FIG. 7. This circuit works by determining the maximum, minimum, and average values of the active channel's $V_{CH}$ inputs taken as a group, and performing computations with those values to determine which of the inputs is responsible for the error. The output signals from this voltage detector are then used by the fault logic 21 and the control memory 16 to take action to turn off the faulty channel. The fault logic and control memory will be detailed separately later.

DETAILED DESCRIPTION OF THE EMBODIMENTS

Figure 1:
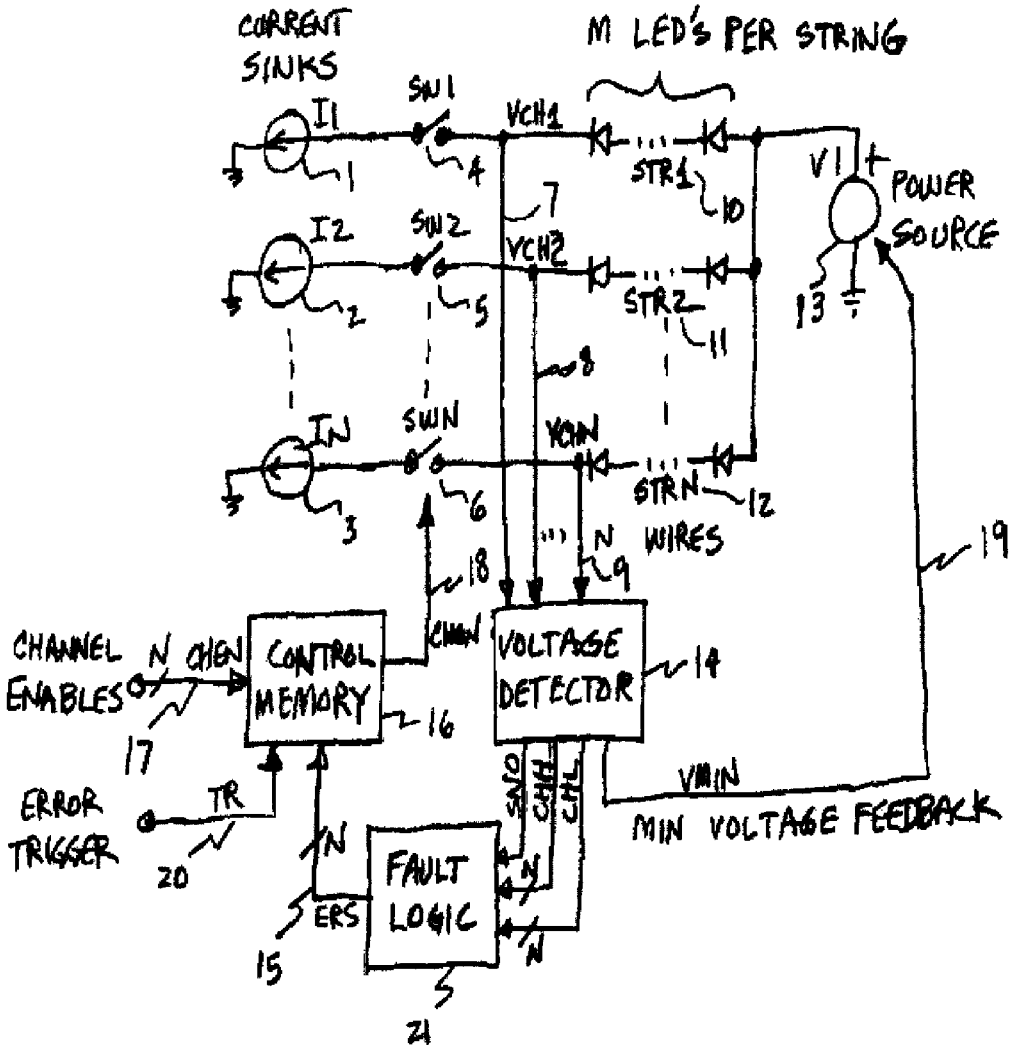
FIG. 1 depicts a power control system for strings of LEDs.
Figure 2:
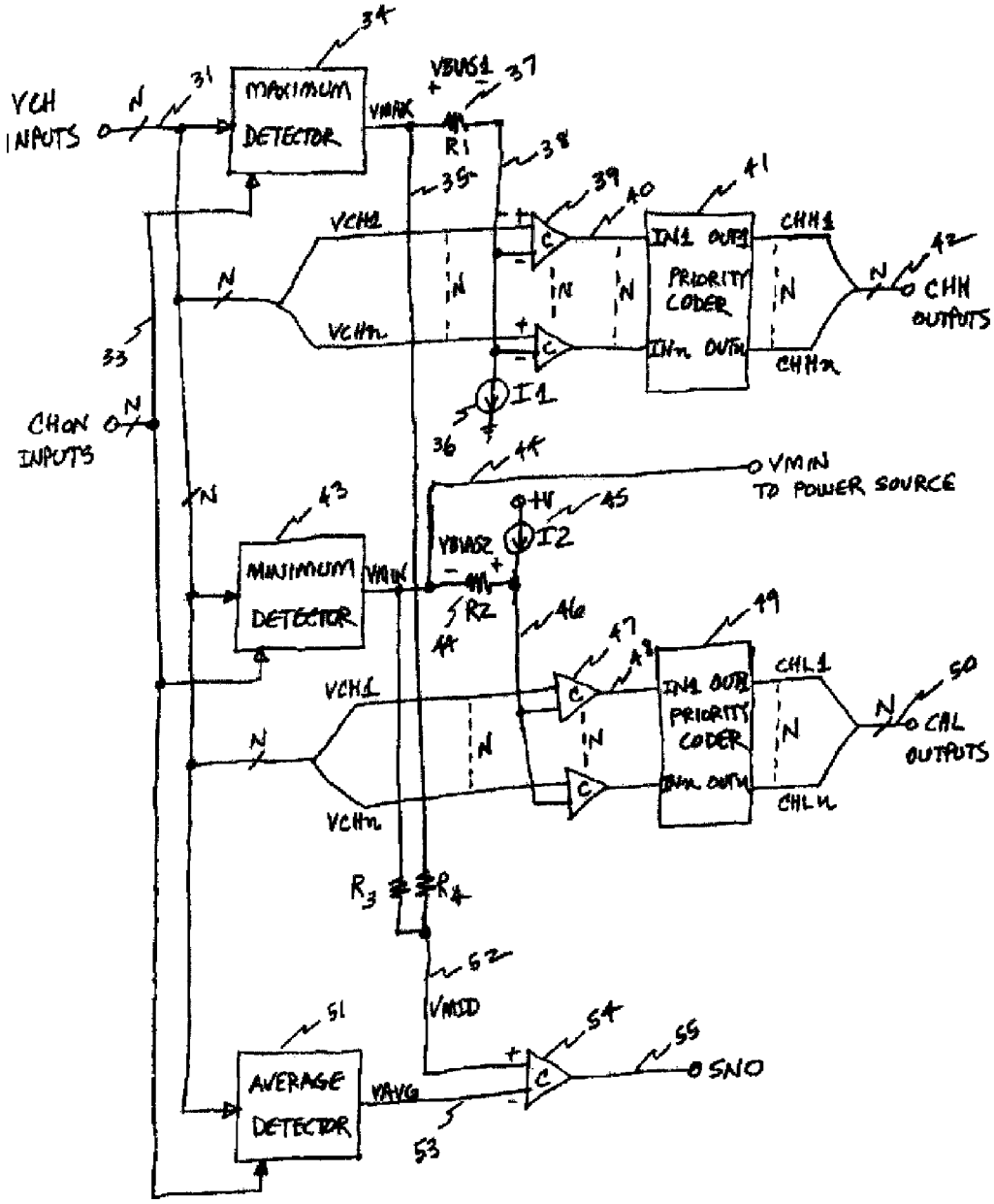
FIG. 2 depicts a voltage detector.

Operation of the voltage detector in FIG. 2 begins with the channel voltage inputs $V_{CH}$ on wire group 31, corresponding to wires 7 through 9 in FIG. 1. These voltages go into a maximum detector 34, together with the $CH_{ON}$ signals 33. The maximum detector determines the voltage value of the channel with the largest voltage $V_{CH}$, and which is indicated as active by the associated channel on signal $CH_{ON}$. If a particular channel has its $CH_{ON}$ signal off or inactive, then the associated $V_{CH}$ signal will not be used in determining the value of the maximum voltage output $V_{MAX}$ on wire 35.

Figure 3:
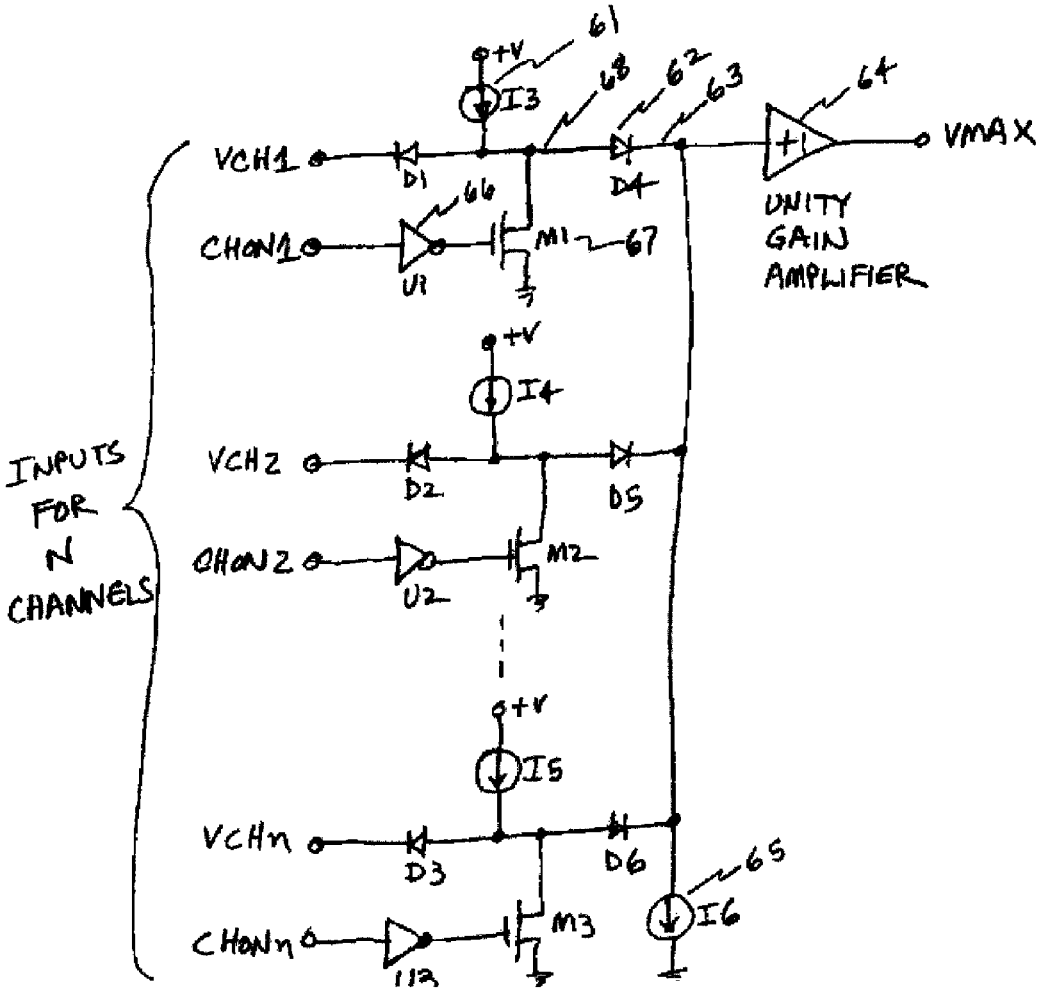
FIG. 3 depicts a circuit for detecting the maximum voltage across a set of channels.

FIG. 3 shows a typical means for making the maximum voltage detector 34 of FIG. 2. There are many ways known in the state of the art for making a circuit which is capable of selecting and outputting the largest of a set of input voltages. This figure shows one method which has been used to make the maximum detector. Operation begins with the input signal set consisting of N wires carrying signals $V_{CH1}$ through $V_{CHn}$, which come from wire group 31 in FIG. 2. One of these wires will have a signal voltage more positive than the remaining ones, and the objective is to output a representative value of $V_{MAX}$ corresponding to the most positive of the input signals.

Each of the input signals goes first through a diode, for example $D_1$ through $D_3$, to provide temperature compensation. The current sources $I_3$ through $I_5$, denoted 61, provide bias current to keep the temperature compensation diodes $D_1$ through $D_3$ always in the forward conduction region of operation. Then the signal goes through a second diode 62 in each signal path connected with the opposite polarity denoted $D_4$ through $D_6$ to the common bus 63. A current sink $I_6$ denoted 65 sinks an amount of current typically half of the value of the first sources 61 from the common bus. This causes one of the diodes in the set $D_4$ through $D_6$ denoted 62 to conduct. Which diode conducts depends on which of the input signals $V_{CH}$ is most positive. If for example, $V_{CH1}$ is most positive, then diode D4 will conduct, causing the common bus 63 to have a voltage similar to $V_{CH1}$. Because $I_6$ is half of the value of $I_3$, the diodes $D_1$ and $D_4$ in this case will have similar currents passing through them, so that their voltage drops can be identical. This makes the difference between the voltage on $V_{CH1}$ and the bus 63 small.

It is important that the maximum detector in FIG. 3 has the ability to ignore input signals $V_{CH}$ from channels which are not in use. To provide this capability, the MOSFET switches $M_1$ through $M_3$ denoted 67 are used. If the control input $CH_{ON}$ corresponding to a particular channel voltage $V_{CH}$ is not active or is at a logic low level, the corresponding logic inverter U1 to U3 denoted 66 will put out a positive or high level logic signal. This signal turns on the associated MOSFET switch $M_1$ through $M_3$, pulling down the intermediate voltage node 68, and preventing the diode 62 from conducting current. Diode 62 is kept in a non-conducting state even when the channel input voltage $V_{CH}$ is at zero, because practical semiconductor diodes 62 require a non-zero voltage across their terminals of 0.3 volts or more for significant current conduction.

Finally, a unity gain buffer amplifier 64 is used to isolate the voltage bus 63 from current that may be drawn by external circuitry connected to the output $V_{MAX}$. Any convenient means known in the state of the art may be used to make the unity gain amplifier. In this example, an operational amplifier was constructed using MOSFET transistors as is commonly known. The operational amplifier has direct feedback to make a unity gain amplifier to provide current to drive load circuits, while having essentially zero voltage offset between its input from bus 63 and its output $V_{MAX}$. The typical voltage range for $V_{MAX}$ in this implementation of the voltage detector circuit is 0 to plus 3 volts.

Referring again to FIG. 2, the $V_{MAX}$ voltage next goes through the resistor R1 denoted 37, where a bias or offset voltage $V_{BIAS1}$ is added to $V_{MAX}$. Current from the current sink $I_1$ denoted 36 flowing through R1 creates the voltage drop $V_{BIAS1}$. A typical value for $V_{BIAS1}$ is 50 millivolts, so the voltage on wire 38 will be slightly lower than $V_{MAX}$. The bias subtraction is implemented simply by use of a series resistor with a constant bias current flowing through it. Comparators 39 then compare the channel voltages $V_{CH}$ individually with the biased voltage on wire 38, resulting in one or more of the comparator outputs 40 being active. Normally only one of the comparator outputs 40 will be active, but if two or more of the $V_{CH}$ inputs are nearly equal, then more than one output can be active. Since the overall circuit needs to have a single channel being chosen, a priority coder 41 is used to select only one channel to be turned off. The priority coder is a digital logic circuit which has the property that if only one input is active, then only one corresponding output will be active. If more than one input is active, then one output corresponding to one of the active inputs will be chosen to be active, and all other outputs are inactive. The output signals $CH_H$ from the priority coder 41 will have only one signal active at a time, denoting which of the input signals $V_{CH}$ is chosen as the most positive. The priority coder may be made from standard logic gate circuits as known in the state of the art.

Figure 4:
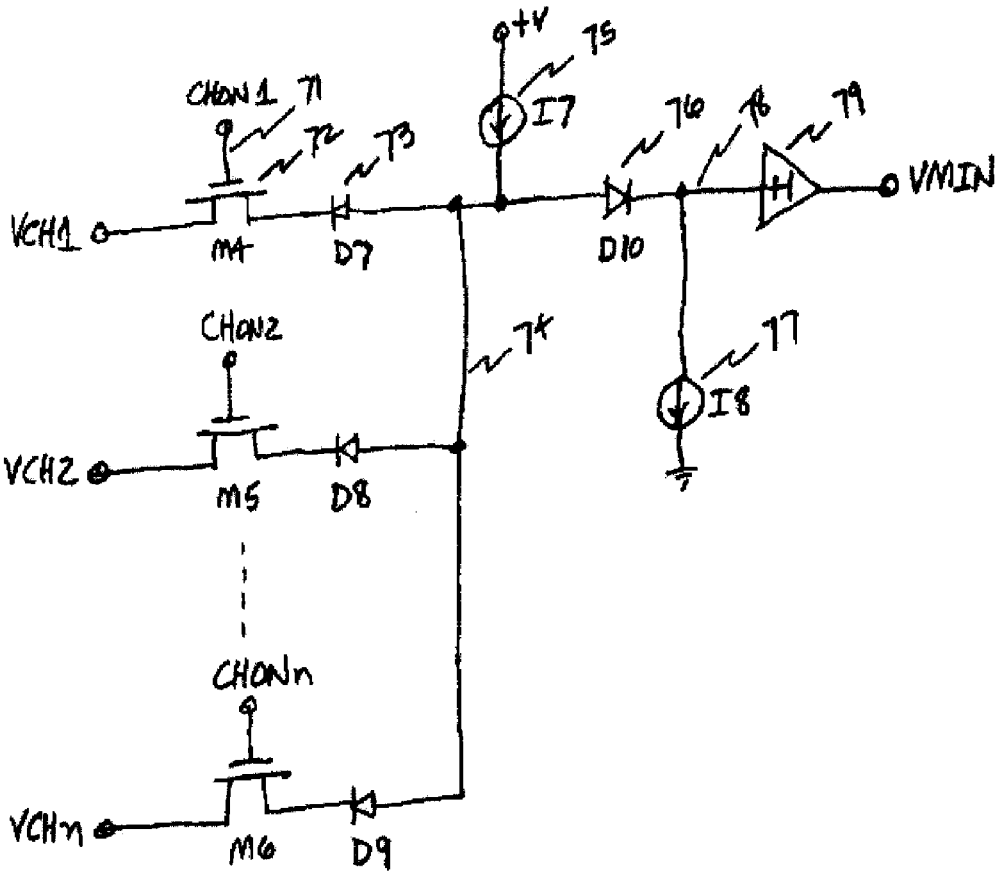
FIG. 4 depicts a circuit for detecting the minimum voltage across a set of channels.

In a similar manner, FIG. 2 shows a minimum detector, offset bias, set of comparators, and a priority coder used to determine the channel which has the lowest voltage $V_{CH}$. The details of one realization of the minimum detector are shown in FIG. 4. There are many ways known in the state of the art for making a circuit which is capable of selecting and outputting the smallest of a set of input voltages. Input channel voltages $V_{CH}$ go first through MOSFET transistors $M_4$ through $M_6$, denoted 72, and then to diodes $D_7$ through $D_9$, denoted 73. The MOSFET transistors act as switches, so that signal flow can be turned on and off by the channel control signals $CH_{ON}$. If a particular signal $CH_{ON}$ is inactive or at a low voltage, then the corresponding $V_{CH}$ current path is broken, and the minimum detector output $V_{MIN}$ cannot be influenced by that $V_{CH}$ signal. If a signal $CH_{ON}$ is active, the MOSFET is on or conducting current, and the corresponding $V_{CH}$ signal will be used in computing the $V_{MIN}$ output.

For the $V_{CH}$ channels which have $CH_{ON}$ active, one of the corresponding diodes $D_7$ through $D_9$ will conduct, pulling the common signal bus 74 towards a lower voltage. Which diode conducts depends on which of the active or selected $V_{CH}$ inputs is the lowest. Since the voltage on bus 74 includes influence due to the forward voltage drop of the conducting diode $D_7$ through $D_9$, a compensating diode $D_{10}$ denoted 76 is included in the signal path. Current source 75 provides bias current to turn on the diode 73 connected to the $V_{CH}$ signal with the lowest voltage, and also the compensating diode 76. Current source 77 has a value $I_8$ which is one half of the current $I_7$ of source 75. Therefore diodes 73 and 76 will have similar voltage drops which will cancel temperature effects, so that the voltage on the wire 78 will be similar to the voltage $V_{CH}$ of the channel with the lowest voltage.

Finally, a unity gain buffer amplifier 79 is used to isolate the voltage bus 78 from current that may be drawn by external circuitry connected to the output $V_{MIN}$. Any convenient means known in the state of the art may be used to make the unity gain amplifier. In this example, an operational amplifier was constructed using MOSFET transistors as is commonly known. The operational amplifier has direct feedback to make a unity gain amplifier to drive load currents, while having essentially zero voltage offset between its input from bus 78 and its output $V_{MIN}$. The typical voltage range for $V_{MIN}$ in this implementation of the voltage detector circuit is 0 to plus 3 volts. An auxiliary connection 19 in FIG. 1 from $V_{MIN}$ to the power source 13 is used to control the value of V1 so that all current sinks of active channels have sufficient voltage for proper operation.

Referring again to FIG. 2, the $V_{MIN}$ voltage next goes through the resistor R2 denoted 44, where a bias or offset voltage $V_{BIAS2}$ is added to $V_{MAX}$. Current from the current source $I_2$ denoted 45 flowing through R1 adds the voltage $V_{BIAS2}$. A typical value for $V_{BIAS2}$ is 50 millivolts, so the voltage on wire 46 will be slightly higher than $V_{MIN}$. The bias addition is implemented simply by use of a series resistor with a constant bias current flowing through it. Comparators 47 then compare the channel voltages $V_{CH}$ individually with the biased voltage on wire 46, resulting in one or more of the comparator outputs 48 being active. Normally only one of the comparator outputs 48 will be active, but if two or more of the $V_{CH}$ inputs are nearly equal, then more than one output can be active. Since the overall circuit needs to have a single channel being chosen, a priority coder 49 is used to select only one channel to be turned off. The priority coder is a digital logic circuit which has the property that if only one input is active, then only one corresponding output will be active. If more than one input is active, then one output corresponding to one of the active inputs will be chosen to be active, and all other outputs are inactive. The output signals CHL from the priority coder 49 will have only one signal active at a time, denoting which of the input signals $V_{CH}$ is chosen as the most negative.

Figure 5:
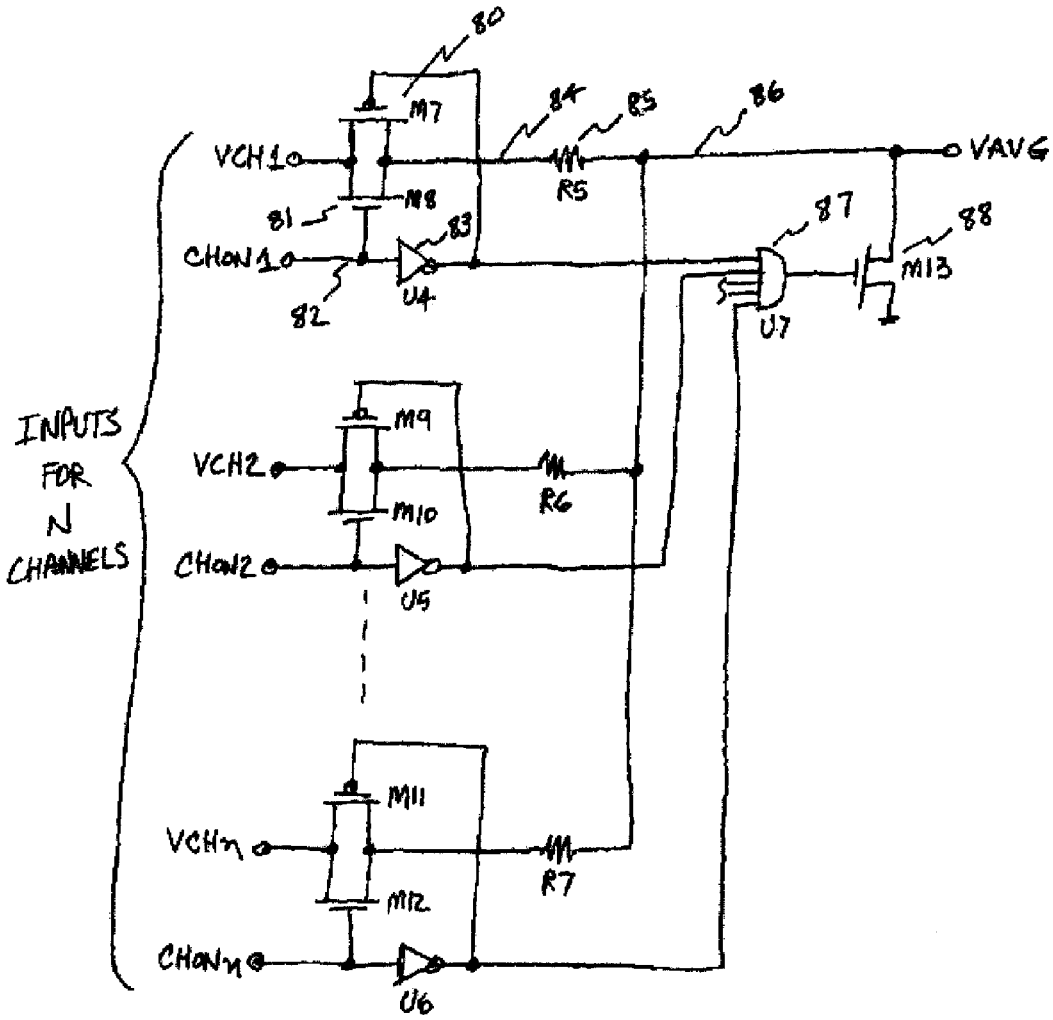
FIG. 5 depicts a circuit for detecting the average voltage across a set of channels.

As shown in FIG. 2, a third metric of the input channel voltage set $V_{CH1}$ to $V_{CHn}$ which must be generated is the average of all the channels which are operating. FIG. 5 shows a circuit which may be used to generate the average of a selected group of voltage signals. Each signal input $V_{CH}$ goes first to an analog switch or transmission gate, formed by a complementary pair of MOSFET transistors. Transistor M7 is a PMOS device, which conducts current when its gate voltage is more negative than its source or drain terminals, and transistor M8 is an NMOS device, which conducts current when its gate voltage is more positive than its source or drain terminals. When these two transistors are conducting, the wire 84 is connected to the input signal $V_{CH}$ through a relatively low resistance path. This supplies the input signal $V_{CH}$ to one terminal of the resistor R5, denoted 85.

Control of the gates of M7 and M8, and therefore the conducting state of the analog switch, is done by the control signal $CH_{ON1}$ for the input $V_{CH1}$, and corresponding signals for the other input voltages $V_{CH}$. If $CH_{ON1}$ is active or at a positive voltage, that is applied to the gate of NMOS transistor M8 denoted 81 and causes it to conduct current. At the same time, the voltage CHON1 is logically inverted by the device U4, so that the gate of transistor M7 denoted 80 is held at zero volts, causing M7 to conduct current. So when CHON1 is active, the analog switch connects the resistor 85 to the input $V_{CH1}$.

Conversely, if the control signal CHON1 is inactive or at zero volts, the transistor M8 has its gate at zero volts, so it is off and not conducting. The logic inverter will put out a positive voltage, so that the gate of the transistor M7 has its gate at a positive voltage, so it also is off and not conducting. As a result, the wire 84 is not connected to the input signal $V_{CH}$, and the resistor 85 has one terminal effectively without any connection, not capable of providing any current to the resistor 85 or the output wire 86. Therefore the voltage at the output $V_{AVG}$ cannot be influenced by $V_{CH}$ signals for which the corresponding control signal CHON is inactive.

Figure 6:
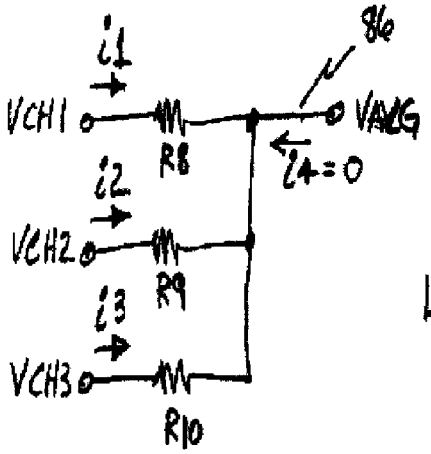
FIG. 6 depicts a set of resistive summation equations.

Applying Kirchoff's current law to the node represented by wire 86, we can show that this circuit will generate the average of the input voltages $V_{CH}$ which are connected to resistors 85. The equations for this derivation are presented in FIG. 6, assuming that there is no load current on the output voltage $V_{AVG}$. This requirement is easily met in a practical circuit. For this derivation, assume an example circuit with three active inputs. The sum of the currents through the resistors R8 through R10 is zero, since there is no load current. If we choose all resistors R8 through R10 have the same value R, then the variable R cancels out and the current balance equation simplifies to $V_{CH1}+V_{CH2}+V_{CH3}=3*V_{AVG}$. It is obvious that this equation can be generalized to the case with N active inputs as $V_{CH1}+\ldots+V_{CHn}=N*V_{AVG}$. Given the circuit shown in FIG. 5, the inputs with CHON inactive will not have a connection to their summing resistor 85, so the circuit will generate an output voltage $V_{AVG}$ according to equation (4) of FIG. 6, where N is the number of signal inputs $V_{CH}$ which are active. Signal inputs with CHON turned off will be ignored in computation of the average voltage $V_{AVG}$. Therefore in FIG. 5, $V_{AVG}=(V_{CH1}+\ldots+V_{CHn})/N$.

One additional function provided in FIG. 5 is control of the value of $V_{AVG}$ when all the CHON inputs are inactive. This can happen for instance when the overall system is turned off by having all CHEN signals 17 in FIG. 1 inactive. In that case, all the analog switches are turned off, and the $V_{AVG}$ voltage on wire 86 is undefined. This condition can cause problems with circuits which use $V_{AVG}$ drawing excessive power supply current or being damaged. Therefore MOSFET device M13 is used to connect wire 86 to ground when all inputs are inactive. The AND gate U7 detects that all inputs are inactive and turns on transistor M13.

Now referring again to FIG. 2, a circuit is used with two resistors R3 and R4 to produce a voltage on wire 52 which is a weighted average of $V_{MAX}$ and $V_{MIN}$. If R3=R4, then wire 52 will have exactly the average of $V_{MAX}$ and $V_{MIN}$. Designate this voltage as $V_{MID}=(V_{MAX}+V_{MIN})$ divided by 2. For some system operation purposes, it may be desirable for R3 not to be equal to R4. The $V_{MID}$ voltage on wire 52 is then compared to $V_{AVG}$ from the average detector 51 as disclosed in FIG. 5 by a voltage comparator 54 made with MOSFET inputs as known in the state of the art. When $V_{MID}$ is more positive than $V_{AVG}$, the output of the comparator 54 on wire 55 denoted as SNO will go active. An active signal at SNO discloses that considering the group of signals $V_{CH}$, there is a signal which is more positive than $V_{AVG}$ by a value which is greater than the difference between $V_{AVG}$ and the $V_{CH}$ signal which is most negative.

Now that we have a circuit which can tell whether the statistical midpoint of the distribution of the $V_{CH}$ signals is higher or lower than the average value of all the $V_{CH}$ signals, it is possible to determine whether the cause of a fault is a channel whose $V_{CH}$ is too high or too low. If SNO is active, then the fault must be caused by the channel whose $V_{CH}$ is most positive. That information is available from examination of the CHH signals 42 to see which one is active. If SNO is inactive, then the fault must be caused by the channel whose $V_{CH}$ is most negative. That information is available from examination of the CHL signals 50 to see which one is active. This examination will be performed by logic in the fault logic block 21 of FIG. 1, detailed here in FIG. 7.

Figure 7:
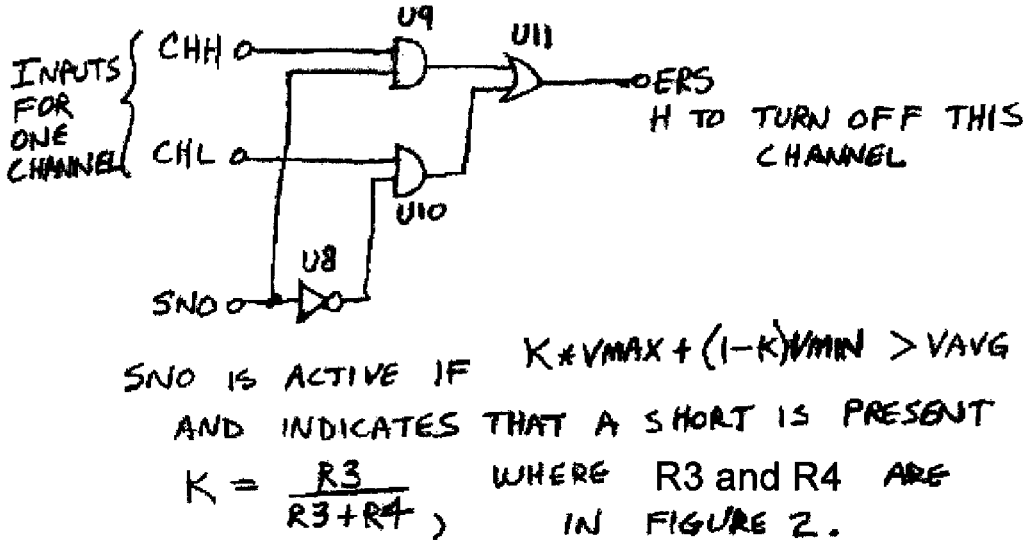
FIG. 7 depicts a circuit for fault detection.

FIG. 7 shows the fault logic used by each channel in the fault logic block 21 of FIG. 1. Any other equivalent means of constructing logic circuitry as known in the state of the art may be used. This logic circuit determines which of the channels should be turned off if a fault occurs. The SNO input will be active if $K*V_{MAX}+(1-K)*V_{MIN}>V_{AVG}$, where K=R3/(R3+R4) in FIG. 2. This is a general indicator that a channel has significantly less voltage drop than the remaining active channels, and is usually caused by one or more LEDs in the channel which are shorted out or have low voltage drop. If SNO is not active, then this generally indicates that a channel has significantly more voltage drop than the remaining channels, and is usually caused by an open LED in the channel. If SNO is active, then the channel whose CHH output is active should be turned off, so this logic makes that determination and sends a signal on the corresponding ERS output to turn off the latch for the defective channel. Use of a K value not equal to 0.5 can be done for example to favor turning off strings with open LEDs instead of strings with shorted LEDs when both occur.

An active level at SNO causes AND gate U9 to pass the active CHH signal for the faulty channel to the OR gate U11 and then to the output ERS for this channel. The ERS signal will not be used unless a trigger or fault indicator TR is active, indicating that a channel needs to be turned off. When TR is not active, the ERS outputs are ignored. When SNO is not active its state is inverted by the logic inverter U8, allowing the AND gate U10 to pass the active CHL signal for the faulty channel to the OR gate U11 and then to the output ERS for this channel. If the TR signal is active, the ERS signal will turn off the faulty channel.

Figure 8:
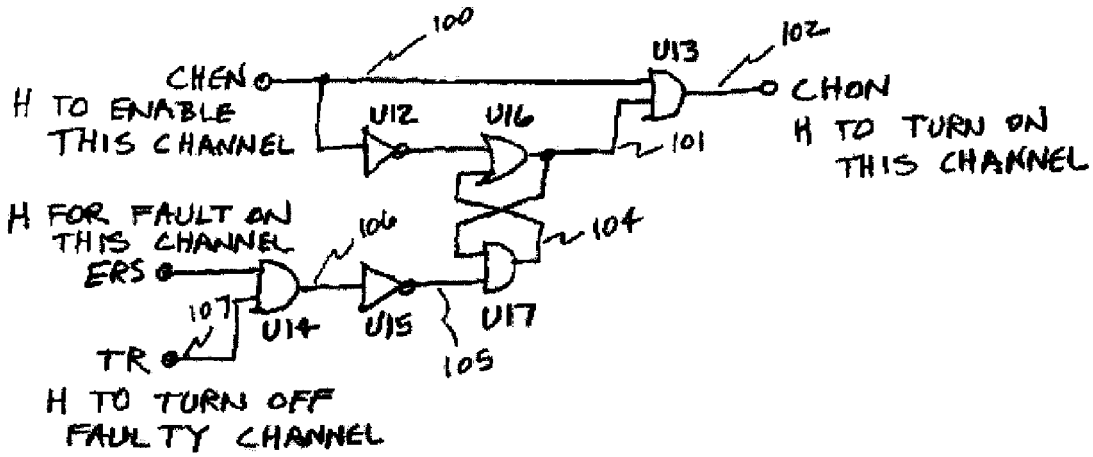
FIG. 8 depicts a control memory system.

FIG. 8 shows the control memory used by each channel. Any other equivalent means of constructing logic circuitry as known in the state of the art may be used. This circuit uses a memory device or flip flop formed by the AND gate U17 and the OR gate U16 to remember whether a channel should be allowed to operate. Initially the channel enables from other circuitry CHEN are at an inactive state, causing all LED channels to be off. Assume that no faults are present, so the fault trigger signal TR 107 is inactive. Then the output of the AND gate U14 will be inactive, and the logic inverter U15 will cause the signal on wire 105 to be active. In this case, U12 inverts the logic state of the CHEN signal and causes the output of the OR gate U16 to be active. The AND gate U17 has its input 105 active, so its output 104 will also become active. Wire 104 feeds back to the second input of OR gate U16, keeping its output active. Therefore wire 101 is active at the second input of AND gate U13.

When the channel enable CHEN 100 is taken active, the AND gate U13 will then create an active output on wire 102 to turn on the channel with the signal CHON. At the same time, the output of inverter U12 becomes inactive, but the memory formed by U16 and U17 remembers that the channel was previously turned off and a fault was not present. As long as a fault does not occur in this channel, the memory will retain its state and the channel output CHON will be active.

However, if an ERS output from the voltage detector and fault logic of FIG. 1 becomes active, then occurrence of a fault condition, signaled by TR becoming active, will turn off the channel with the active ERS signal. Coincidence of the ERS and TR signals is detected by the AND gate U14, causing the wire 106 to go active. The inverter U15 then causes the wire 105 to become inactive, causing the AND gate U17 to make its output inactive on wire 104. Since wire 104 was the only source of an active signal at the inputs of the OR gate U16, the output on wire 101 of gate U16 will become inactive. This does two things. Firstly, it turns off the second input of the AND gate U13, causing the CHON output for the faulty channel to become inactive and turning the faulty channel off.

Secondly, it feeds back to an input of U17, causing its output 104 to stay inactive. Thus the memory formed by U16 and U17 will remember that a fault condition has occurred, and will keep the CHON output turned off until the memory is reset by making the CHEN input inactive.

Although the logic circuitry shown in the FIGS. 1 through 8 use discrete logic gates and inverters, which may be conveniently implemented using MOSFET technology, a person who is skilled in the art may use some other type of logic devices or technology to produce the same results. It is also possible to implement the logic functions using combinations of software and computational elements according to the state of the art. The important item of the circuits disclosed is the functional performance achieved by the disclosed implementation, and not the actual means of implementation. Any person skilled in the art may change at will the technology and realization of the functions disclosed here without changing the actual function performed by the disclosed error detection system.

Figure 9:
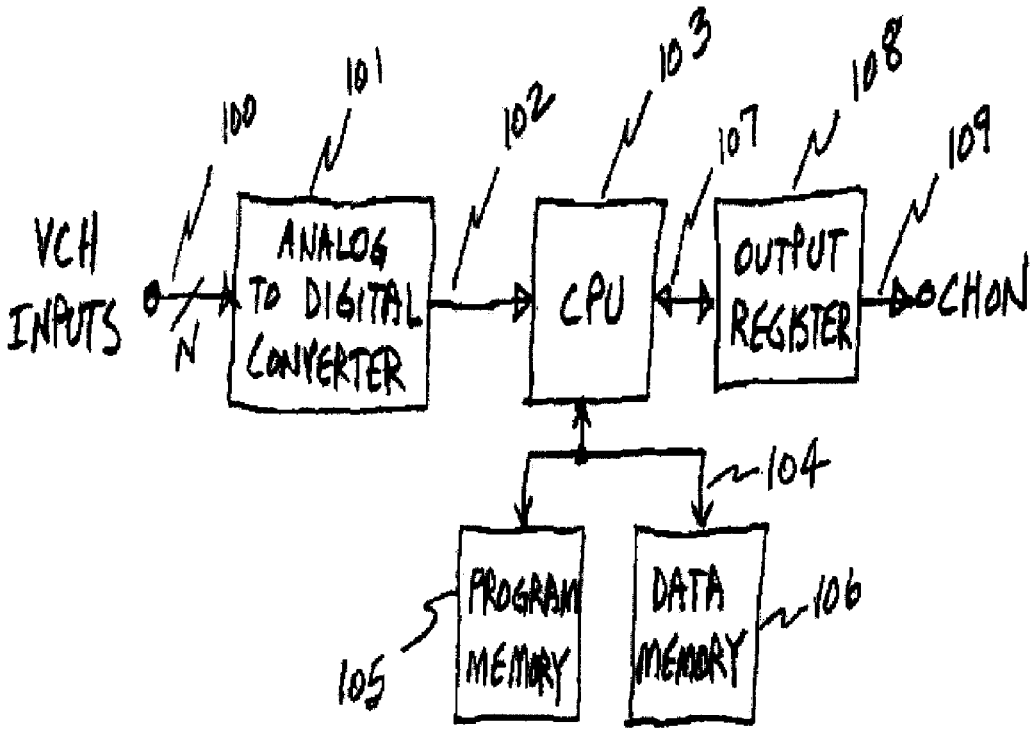
FIG. 9 depicts a block diagram of a software implementation of an embodiment.

FIG. 9 shows one realization of a method for performing the selection and control of a faulty LED channel using software. In this method, the channel voltage signals $V_{CH}$ from N channels 100, corresponding to wires 7 to 9 in FIG. 1, are first sent through an analog to digital converter (ADC) denoted 101. This circuit can use any of a multiplicity of techniques as known in the state of the art for making ADC circuits. The conversion can be performed by multiple ADCs in parallel, or serially using an analog signal multiplexer to choose inputs $V_{CH}$ on at a time for conversion by a single ADC. The result is the same, as digital representations of the analog voltages $V_{CH}$ are provided to a central processing unit (CPU) on wires 102.

The CPU denoted 103 then uses program information stored in a program memory 105 to manipulate the data 102 according to predetermined algorithms. These algorithms can perform such tasks as finding the digital number representing the most positive input voltage $V_{CH}$, the digital number representing the most negative input voltage $V_{CH}$, the digital number representing the average of all the $V_{CH}$ input voltages, and the digital number representing the weighted average of the most positive and most negative input voltages $V_{CH}$. Further, the algorithms can make choices such as comparing the average input value with the weighted average of the most positive and most negative input values, and determination of the channel number for which the most positive and most negative values occur. Communication between the CPU, the program memory, and a data storage memory is done over a group of wires 104, which could carry data, program instructions, and memory address and control signals as needed. A data memory 106 is provided for temporary storage of variable numbers and computed values, such as the digital numbers representing the input $V_{CH}$ values, and the intermediate and final results of the various algorithm operations.

The final result of the CPU computations according to its algorithms is output on a set of wires to an output register or equivalent means 108, where the information is stored. This stored information is the channel turn-on information CHON 109, which will denote whether any particular LED channel is to be operating or not. These CHON signals are identical with the signals on wires 18 in FIG. 1. The CHON signals may be used to control the switches or equivalent SW1 through SWn in FIG. 1. The computer system with its CPU and memory may also be programmed to output a control signal, either analog or digital, for use on wire 19 in FIG. 1. This signal takes advantage of the CPU knowledge of the channel input voltages $V_{CH}$ to generate a control signal for the voltage source 13 generating voltage $V_1$, thereby keeping the LED current sinks $I_1$ to $I_n$ operating correctly.

In addition to controlling the LED channels, the CHON information can be used by the algorithms in the CPU calculations. This information is specifically valuable for telling the algorithms when to ignore a $V_{CH}$ input because the LED channel has been turned off. When an LED channel is off, the measured $V_{CH}$ value may no longer have any validity. Unless the unused LED channels are excluded from the algorithmic operation, the calculations performed by the CPU will not be correct. All of these activities may be easily performed in the routine course of execution of instructions by the CPU unit.

What is claimed is:

1. An LED system, comprising:

a plurality of sets of LED devices, wherein each set comprises one or more LED devices;

a detector circuit for detecting the maximum voltage associated with said plurality of sets and providing the maximum voltage as an output; and a controller for disabling one of said plurality of sets in response to the output.

2. The system of claim 1, wherein said detector circuit comprises one or more diodes for each set.

3. The system of claim 2, wherein said detector circuit further comprises a current source for each set.

4. The system of claim 3, wherein said detector circuit further comprises a common current sink coupled to each set.

5. The system of claim 1, wherein each set comprises one LED device.

6. The system of claim 1, wherein each set comprises two or more LED devices.

7. An LED system, comprising:

a plurality of sets of LED devices, wherein each set comprises one or more LED devices;

a detector circuit for detecting the minimum voltage associated with said plurality of sets and providing the minimum voltage as an output; and a controller for disabling one of said plurality of sets in response to the output.

8. The system of claim 7, wherein said detector circuit comprises one or more diodes for each set.

9. The system of claim 8, wherein said detector circuit comprises a MOSFET transistor for each set.

10. The system of claim 9, wherein said detector circuit further comprises a common current source coupled to each set.

11. The system of claim 7, wherein each set comprises one LED device.

12. The system of claim 7, wherein each set comprises two or more LED devices.

13. An LED system, comprising:

a plurality of sets of LED devices, wherein each set comprises one or more LED devices;

an average detector circuit for determining the average of the voltages associated with said plurality of sets and providing the average of the voltages as an output;

a controller for determining the cause of a fault in said LED system in response to the output.

14. The system of claim 13, wherein the average detector circuit comprises a pair of complementary MOSFET transistors for each set.

15. The system of claim 13, further comprising:

a maximum detector circuit for detecting the maximum voltage associated with said plurality of sets, wherein said controller is configured to disable a set in response to an output of said maximum detector circuit and said average detector circuit.

16. The system of claim 15, further comprising:

a minimum detector circuit for detecting the minimum voltage associated with said plurality of sets, wherein said controller is configured to disable a set in response to an output of said minimum detector circuit and said average detector circuit.

17. The system of claim 15, wherein each set comprises one LED device.

18. The system of claim 15, wherein each set comprises two or more LED devices.

19. The system of claim 15, wherein said controller generates an enable signal for each set.

20. The system of claim 16, wherein said controller generates an enable signal for each set.

21. An LED system comprising:

a plurality of sets of LED devices, wherein each set comprises one or more LED devices;

an average circuit for generating an average voltage that is an average of the voltages across each set and providing the average voltage as a first output;

a maximum detector circuit for detecting the maximum voltage across said sets and providing the maximum voltage as a second output;

a minimum detector circuit for detecting the minimum voltage across said sets and providing the minimum voltage as a third output;

a weighted average circuit for generating a weighted average voltage that is a weighted average of the second output and the third output and providing the weighted average as a fourth output; and a comparator for comparing the fourth output and the first output to indicate a cause of a fault in the LED system.

22. The system of claim 21, wherein said comparator indicates that the fault is caused by a voltage that is too high across one of said sets.

23. The system of claim 22, wherein said comparator indicates that the fault is caused by a voltage that is too low across one of said sets.

24. The system of claim 21, wherein said weighted average circuit weights said maximum voltage and said minimum voltage in equal amounts.

25. The system of claim 21, wherein said weighted average circuit weights said maximum voltage and said minimum voltage in different amounts.

* * * * *